US010969164B2

(12) United States Patent
Wang et al.

(10) Patent No.: US 10,969,164 B2
(45) Date of Patent: Apr. 6, 2021

(54) SINGLE-SYSTEM AIR-COOLED REFRIGERATOR AND CONTROL METHOD THEREFOR

(71) Applicant: QINGDAO HAIER JOINT STOCK CO., LTD., Qingdao (CN)

(72) Inventors: Dazhi Wang, Qingdao (CN); Dongxiao Fu, Qingdao (CN); Wei Wang, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 62 days.

(21) Appl. No.: 16/345,243

(22) PCT Filed: Oct. 25, 2017

(86) PCT No.: PCT/CN2017/107587

§ 371 (c)(1),
(2) Date: Apr. 25, 2019

(87) PCT Pub. No.: WO2018/077175

PCT Pub. Date: May 3, 2018

(65) Prior Publication Data

US 2019/0277559 A1 Sep. 12, 2019

(30) Foreign Application Priority Data

Oct. 25, 2016 (CN) ..... 201610940376.X

(51) Int. Cl.
*F25D 29/00* (2006.01)
*F25D 11/02* (2006.01)
*F25D 17/06* (2006.01)

(52) U.S. Cl.
CPC ..... *F25D 29/003* (2013.01); *F25D 11/02* (2013.01); *F25D 17/062* (2013.01);
(Continued)

(58) Field of Classification Search
CPC .. F25D 11/02; F25D 17/062; F25D 2317/061; F25D 2317/067; F25D 2400/16; F25D 2500/06
See application file for complete search history.

(56) References Cited

U.S. PATENT DOCUMENTS 6,314,746 B2 11/2001 Ohya et al.

FOREIGN PATENT DOCUMENTS

CN 2117576 U 9/1992
CN 2274325 Y 2/1998
(Continued)

*Primary Examiner* — Marc E Norman
*Assistant Examiner* — Schyler S Sanks
(74) *Attorney, Agent, or Firm* — Cheng-Ju Chiang

(57) ABSTRACT

A single-system air-cooled refrigerator, comprising a refrigerating compartment and a freezing compartment, wherein the refrigerator further comprises: a first air duct and a second air duct, which communicate the refrigerating compartment with the freezing compartment respectively; a first air door and a second air door which open and close the first air duct and the second air duct respectively; a refrigerating system; and a control system, configured to control opening and closing of the first air door and the second air door to implement a first working mode, a second working mode, or a third working mode of the refrigerator. The first working mode is that neither the freezing compartment nor the refrigerating compartment is switched, the second working mode is that the freezing compartment is switched to the refrigerating compartment, and the third working mode is that the refrigerating compartment is switched to the freezing compartment.

5 Claims, 8 Drawing Sheets

(52) U.S. Cl.
CPC .. *F25D 2317/061* (2013.01); *F25D 2317/067* (2013.01); *F25D 2400/16* (2013.01); *F25D 2500/06* (2013.01)

(56) References Cited

FOREIGN PATENT DOCUMENTS

| | | | | |
|---|---|---|---|---|
| CN | 101082460 | A | 12/2007 | |
| CN | 101086407 | A | 12/2007 | |
| CN | 201093825 | Y | 7/2008 | |
| CN | 103499171 | A | 1/2014 | |
| CN | 203550384 | U | 4/2014 | |
| CN | 105972929 | A | 9/2016 | |
| CN | 205606999 | U | 9/2016 | |
| CN | 106016920 | A | 10/2016 | |
| CN | 106524649 | A | 3/2017 | |
| CN | 106568271 | A | 4/2017 | |
| WO | 2006/123483 | A1 | 11/2006 | |
| WO | WO-2009060272 | A2 * | 5/2009 | ..... F25D 11/02 |

* cited by examiner

SINGLE-SYSTEM AIR-COOLED REFRIGERATOR AND CONTROL METHOD THEREFOR

CROSS REFERENCE TO RELATED APPLICATION

The present application is a 35 U.S.C. § 371 National Phase conversion of International (PCT) Patent Application No. PCT/CN2017/107587, filed on Oct. 25, 2017, which claims priority to Chinese Patent Application No. 201610940376.X, filed on Oct. 25, 2016 and titled "Single-System Air-Cooled Refrigerator and Control Method Therefor", which is incorporated herein by reference in its entirety. The PCT International Patent Application was filed and published in Chinese.

FIELD OF THE INVENTION

The present invention relates to the field of refrigeration, and in particular, to a single-system air-cooled refrigerator and a control method therefor.

BACKGROUND OF THE INVENTION

At present, when the season changes or is at a certain time period, the user has specific needs for storing a large number of specific articles, such as the need for storing frozen fresh food during holidays, and the need for storing large amounts of refrigerated water and fruits during the dry season in tropical areas.

In an ordinary single-system air-cooled refrigerator, cold air is transported to a refrigerating compartment and a freezing compartment by an air duct, and the temperature ranges of the refrigerating compartment and the freezing compartment are relatively fixed.

For the refrigerating compartment and the freezing compartment, although there may be a large temperature adjusting range, the size of an air hole of the ordinary air-cooled refrigerator cannot be adjusted, or the capacity to change the air volume is not enough to reduce the temperature from a temperature above zero to a temperature below zero. Thus, the temperature range of each compartment cannot be adjusted as needed, and the use is inconvenient.

In the prior art, an electric air door can be installed on each air outlet of the refrigerating compartment and the freezing compartment, and the temperature can be changed by the signal control of a sensor. However, such a solution is high in cost and complicated in control. In addition, there is great limitation for the single-system refrigerator.

SUMMARY OF THE INVENTION

Objectives of the present invention are to provide a single-system air-cooled refrigerator and a control method therefor.

To fulfill one of above objectives of the present invention, an embodiment of the present invention provides a single-system air-cooled refrigerator, comprising a refrigerating compartment and a freezing compartment, wherein the refrigerator further comprises: a first air duct and a second air duct, which communicate the refrigerating compartment with the freezing compartment respectively and are separated from each other; a first air door and a second air door which open and close the first air duct and the second air duct respectively; a refrigerating system, configured to supply cold air to the freezing compartment; and a control system, configured to control opening and closing of the first air door and the second air door to implement a first working mode, a second working mode, or a third working mode of the refrigerator, wherein the first working mode is that neither the freezing compartment nor the refrigerating compartment is switched, the second working mode is that the freezing compartment is switched to the refrigerating compartment, and the third working mode is that the refrigerating compartment is switched to the freezing compartment.

As an improvement of an embodiment of the present invention, the refrigerating system comprises a freezing fan and a compressor, and when the refrigerator is in the first working mode or the second working mode, the control system controls the freezing fan to be shut down after controlling the compressor to be shut down for preset delay time.

As a further improvement of an embodiment of the present invention, when the refrigerator is in the first working mode, the freezing compartment is preset to be at a first temperature, the refrigerating compartment is preset to be at a second temperature, the control system controls the second air door to be closed, meanwhile the control system controls the first air door to be opened to a first preset opening degree according to the first temperature and the second temperature, the first temperature is in a freezing temperature range and the second temperature is in a refrigerating temperature range.

As a further improvement of an embodiment of the present invention, when the refrigerator is in the second working mode, the freezing compartment is preset to be at a third temperature, the refrigerating compartment is preset to be at a fourth temperature, the control system controls the second air door to be closed, meanwhile, the control system controls the first air door to be fully opened, and the third temperature and the fourth temperature are both in the refrigerating temperature range.

As a further improvement of an embodiment of the present invention, when the refrigerator is in the third working mode, the freezing compartment is preset to be at a fifth temperature, the refrigerating compartment is preset to be at a sixth temperature, the control system controls the first air door and the second air door to be both fully opened, and the fifth temperature and the sixth temperature are both in the freezing temperature range.

As a further improvement of an embodiment of the present invention, the refrigerating system is communicated with the freezing compartment by a freezing air hole, the first air duct is communicated with the refrigerating compartment by a first refrigerating air hole, the second air duct is communicated with the refrigerating compartment by a second refrigerating air hole, and the first refrigerating air hole and the second refrigerating air hole are both larger than the freezing air hole.

To fulfill one of above objectives of the present invention, an embodiment of the present invention provides a control method for a single-system air-cooled refrigerator, which comprises the steps of: starting the refrigerator; selecting a working mode; switching neither the freezing compartment nor the refrigerating compartment when the working mode is a first working mode; switching the freezing compartment to the refrigerating compartment when the working mode is a second working mode; and switching the refrigerating compartment to the freezing compartment when the working mode is a third working mode.

As an improvement of an embodiment of the present invention, the refrigerator comprises a first air duct and a second air duct which communicate the refrigerating compartment with the freezing compartment respectively and are separated from each other, and a first air door and a second air door which open and close the first air duct and the second air duct respectively, the step "switching neither the freezing compartment nor the refrigerating compartment when the working mode is a first working mode" specifically comprises: presetting the freezing compartment to be at a first temperature and the refrigerating compartment to be at a second temperature when the refrigerator is in the first working mode, the first temperature being in a freezing temperature range, and the second temperature being in a refrigerating temperature range; and controlling the second air door to be closed, and meanwhile controlling the first air door to be opened to a first preset opening degree according to the first temperature and the second temperature.

As a further improvement of an embodiment of the present invention, the refrigerator comprises a first air duct and a second air duct which communicate the refrigerating compartment with the freezing compartment respectively and are separated from each other, and a first air door and a second air door which open and close the first air duct and the second air duct respectively, the step "switching the freezing compartment to the refrigerating compartment when the working mode is a second working mode" specifically comprises: presetting the freezing compartment to be at a third temperature and the refrigerating compartment to be at a fourth temperature when the refrigerator is in the second working mode, the third temperature and the fourth temperature being both in the refrigerating temperature range; and controlling the second air door to be closed while controlling the first air door to be fully opened.

As a further improvement of an embodiment of the present invention, the refrigerator comprises a first air duct and a second air duct which communicate the refrigerating compartment with the freezing compartment respectively and are separated from each other, and a first air door and a second air door which open and close the first air duct and the second air duct respectively, the step "switching the refrigerating compartment to the freezing compartment when the working mode is a third working mode" specifically comprises: presetting the freezing compartment to be at a fifth temperature and the refrigerating compartment to be at a sixth temperature when the refrigerator is in the third working mode, the fifth temperature and the sixth temperature being both in the freezing temperature range; and controlling the first air door and the second air door to be both fully opened.

Compared with the prior art, the present invention has the beneficial effects that the embodiment of the present invention adjusts the cold entering the freezing compartment and the refrigerating compartment by the two air ducts and two air doors, thereby changing the temperatures of the refrigerating compartment and the freezing compartment, achieving free switching of the refrigerating/freezing, and solving the problem of a narrow temperature change range of the refrigerator.

DETAILED DESCRIPTION OF THE EMBODIMENTS

Figure 1:
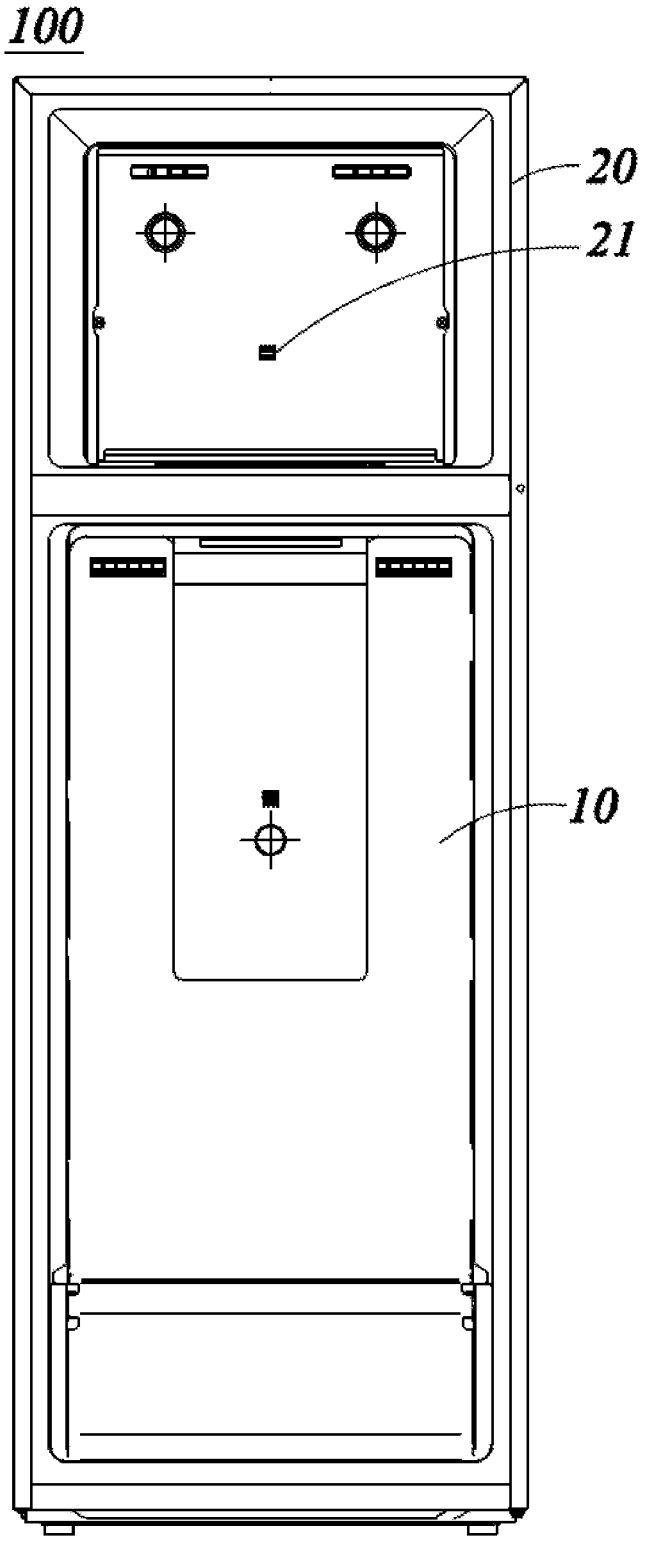
FIG. 1 is a structural schematic diagram of a refrigerator with an air duct cover plate according to a preferred embodiment of the present invention.
Figure 2:
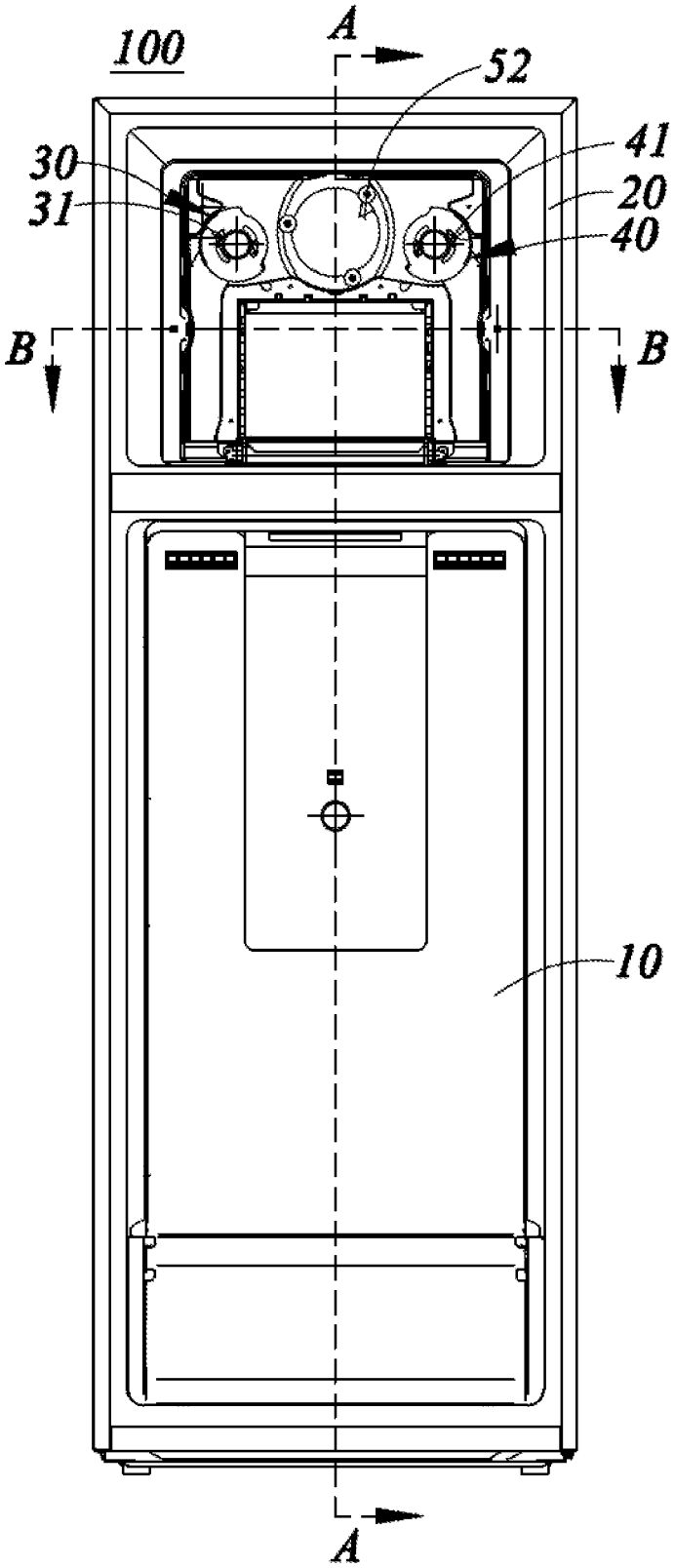
FIG. 2 is a structural schematic diagram of a refrigerator without an air duct cover plate according to a preferred embodiment of the present invention.
Figure 3:
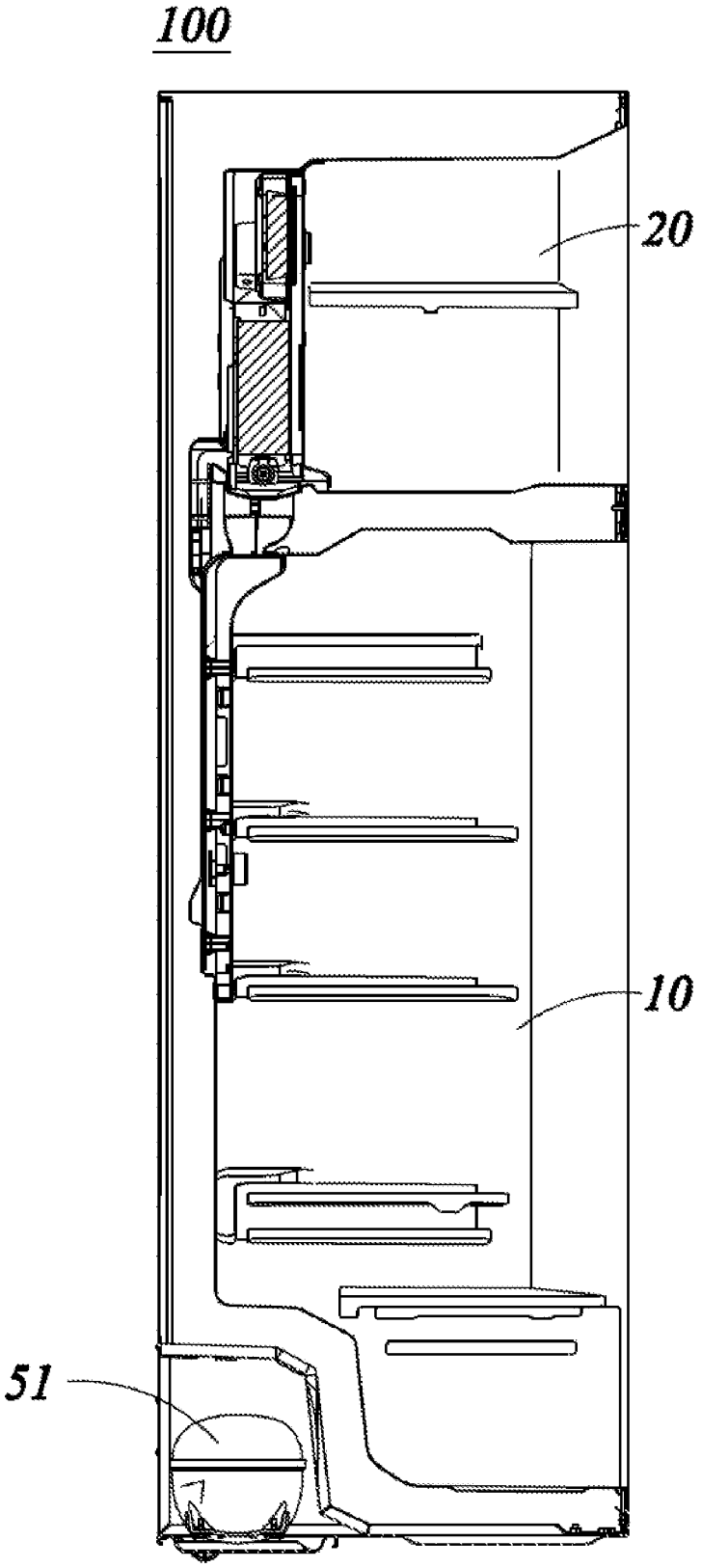
FIG. 3 is an A-A sectional view in FIG. 2.
Figure 4:
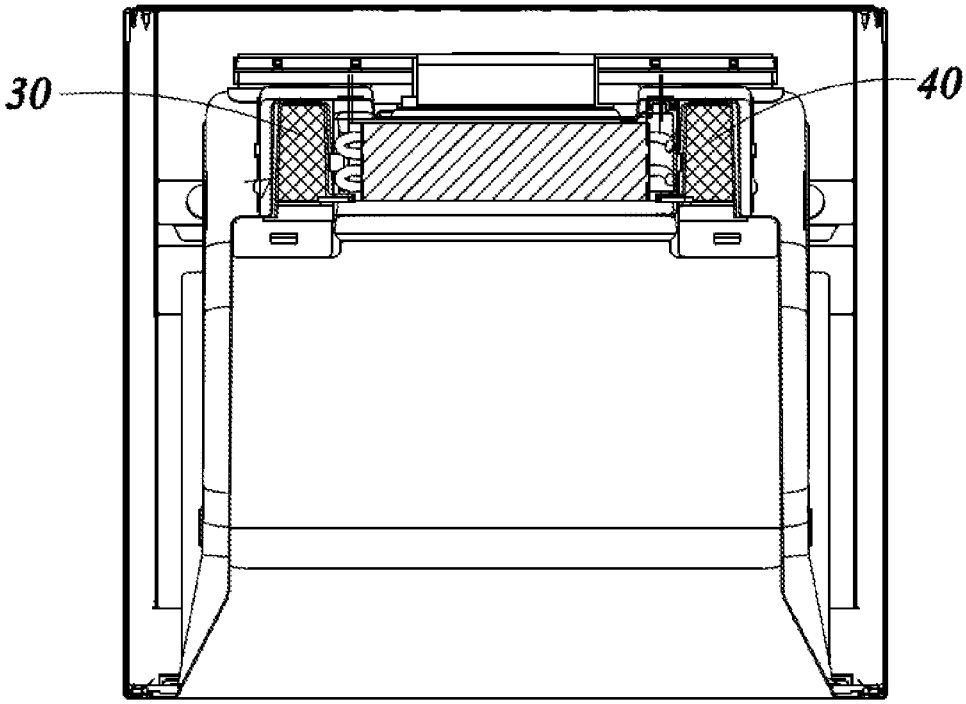
FIG. 4 is a B-B sectional view in FIG. 2.

The present invention will be described in detail below with reference to the specific embodiments shown in the accompanying drawings. However, these embodiments are not intended to limit the present invention, and modifications in structures, methods, or functions made by those common skilled in the art according to these embodiments are all included in the protection scope of the present invention.

In the respective figures of the present application, some dimensions of a structure or portion may be exaggerated relative to other structures or portions for the purpose of illustration, and thus are merely used to illustrate the basic structure of the subject matter of the present application.

In addition, the terms "upper", "above", "lower", "below", and the like as used herein, which denote spatial relative positions, describe the relationship of a unit or feature relative to another unit or feature in the accompanying drawings for the purpose of illustration. The terms of the spatial relative positions may be intended to include different orientations of the device in use or operation other than the orientations shown in the accompanying drawings. For example, the elements that are described as "below" or "under" other elements or features will be "above" other elements or features if the device in the accompanying drawings is turned upside down. Thus, the exemplary term "below" can encompass both the orientations of above and below. The device may be otherwise oriented (rotated by 90 degrees or facing other directions) and the space-related descriptors used herein are interpreted accordingly.

FIG. 1 to FIG. 4 are structural schematic diagrams of a single-system air-cooled refrigerator 100 according to an embodiment of the present invention.

The refrigerator 100 comprises a refrigerating compartment 10 and a freezing compartment 20. Here, the freezing compartment 20 above the refrigerating compartment 10 is taken as an example.

The refrigerator 100 further comprises a first air duct 30 and a second air duct 40 which communicate the refrigerating compartment 10 with the freezing compartment 20 respectively and are separated from each other, and a first air door 31 and a second air door 41 which open and close the first air duct 30 and the second air duct 40 respectively, a refrigerating system (not shown), and a control system (not shown).

The first air duct 30 and the second air duct 40 are covered by an air duct cover plate (not shown).

The first air door 31 and the second air door 41 are mechanical air doors or electronic air doors.

The refrigerating system is configured to supply cold air to the freezing compartment 20. The refrigerating system comprises a compressor 51, a freezing evaporator (not shown), a freezing fan 52, and the like.

The control system is configured to control opening and closing of the first air door 31 and the second air door 41 to implement a first working mode, a second working mode, or a third working mode of the refrigerator 100.

The first working mode is that neither the freezing compartment 20 nor the refrigerating compartment 10 is switched, that is, the refrigerator 100 is an ordinary refrigerating-freezing refrigerator in this working mode.

The second working mode is that the freezing compartment 20 is switched to the refrigerating compartment 10, that is, the refrigerator 100 is entirely a refrigerating refrigerator in this working mode.

The third working mode is that the refrigerating compartment 10 is switched to the freezing compartment 20, that is, the refrigerator 100 is entirely a freezing refrigerator in this working mode.

Here, the cold entering the refrigerating compartment 10 and the freezing compartment 20 is adjusted by the two air ducts (the first air duct 30 and the second air duct 40) and the two air doors (the first air door 31 and the second air door 41), to change the temperatures of the refrigerating compartment 10 and the freezing compartment 20, thereby achieving free switching of refrigerating/freezing, and solving the problem that the temperature change range of the refrigerator 100 is narrow.

That is to say, the user can switch the compartments (the refrigerating compartment 10 and the freezing compartment 20) autonomously when in need. Greater convenience and flexibility are realized. The storage needs of the user for a large number of specific articles when the season changes or is at a certain time period, such as the need for storing frozen fresh food during holidays, and the need for storing large amounts of refrigerated water and fruits during the dry season in tropical areas, are met. More choices and more flexible use experience are given to the user.

In the present embodiment, the refrigerator 100 further comprises a freezing temperature sensor 21 located in the freezing compartment 20 and a refrigerating temperature sensor (not shown) located in the refrigerating compartment 10. The freezing temperature sensor 21 and the refrigerating temperature sensor both connected to the control system.

The control system controls the working of the refrigerating system, the first air door 31, and the second air door 41 according to the freezing temperature sensor 21 and the refrigerating temperature sensor, so as to implement the switching of the refrigerator 100 among the first working mode, the second working mode, and the third working mode.

In the present embodiment, the refrigerating system is communicated with the freezing compartment 20 by a freezing air hole (not shown). The first air duct 30 is communicated with the refrigerating compartment 10 by a first refrigerating air hole (not shown). The second air duct 40 is communicated with the refrigerating compartment 10 by a second refrigerating air hole (not shown). The first refrigerating air hole and the second refrigerating air hole are both larger than the freezing air hole.

Here, by designing the freezing air hole to be smaller than the first refrigerating air hole and the second refrigerating air hole, the volume of air entering the refrigerating compartment 10 can be effectively adjusted, thereby changing the cold distribution of the refrigerating compartment 10 and the freezing compartment 20. Further the temperatures of the refrigerating compartment 10 and the freezing compartment 20 are changed in an assisting manner, so that the conversion of the refrigerating compartment 10 and the freezing compartment 20 can be further achieved between freezing and refrigerating.

When the refrigerating compartment 10 and the freezing compartment 20 are equal in volume, the freezing air hole has a first opening size. When the volume of the refrigerating compartment 10 is larger than the volume of the freezing compartment 20, the freezing air hole has a second opening size. The second opening size is smaller than the first opening size.

That is, when the volume of the refrigerating compartment 10 is relatively large, the cold distributed by the refrigerating compartment 10 needs to be increased to realize the switching of the refrigerating/freezing.

Of course, specific size ratios of the freezing air hole, the first refrigerating air hole and the second refrigerating air hole need to be determined according to simulation calculation and experimental debugging based on a specific condition.

In the present embodiment, when the refrigerator is in the first working mode or the second working mode, the control system controls the compressor 51 to be shut down, and then after preset delay time, the control system controls the freezing fan 52 to be shut down.

That is to say, the freezing fan 52 is substantially in a time-delayed shutdown state, thereby further assisting in the switching of the refrigeration/freezing and power saving.

The three working modes according to the present embodiment are described below.

Figure 5:
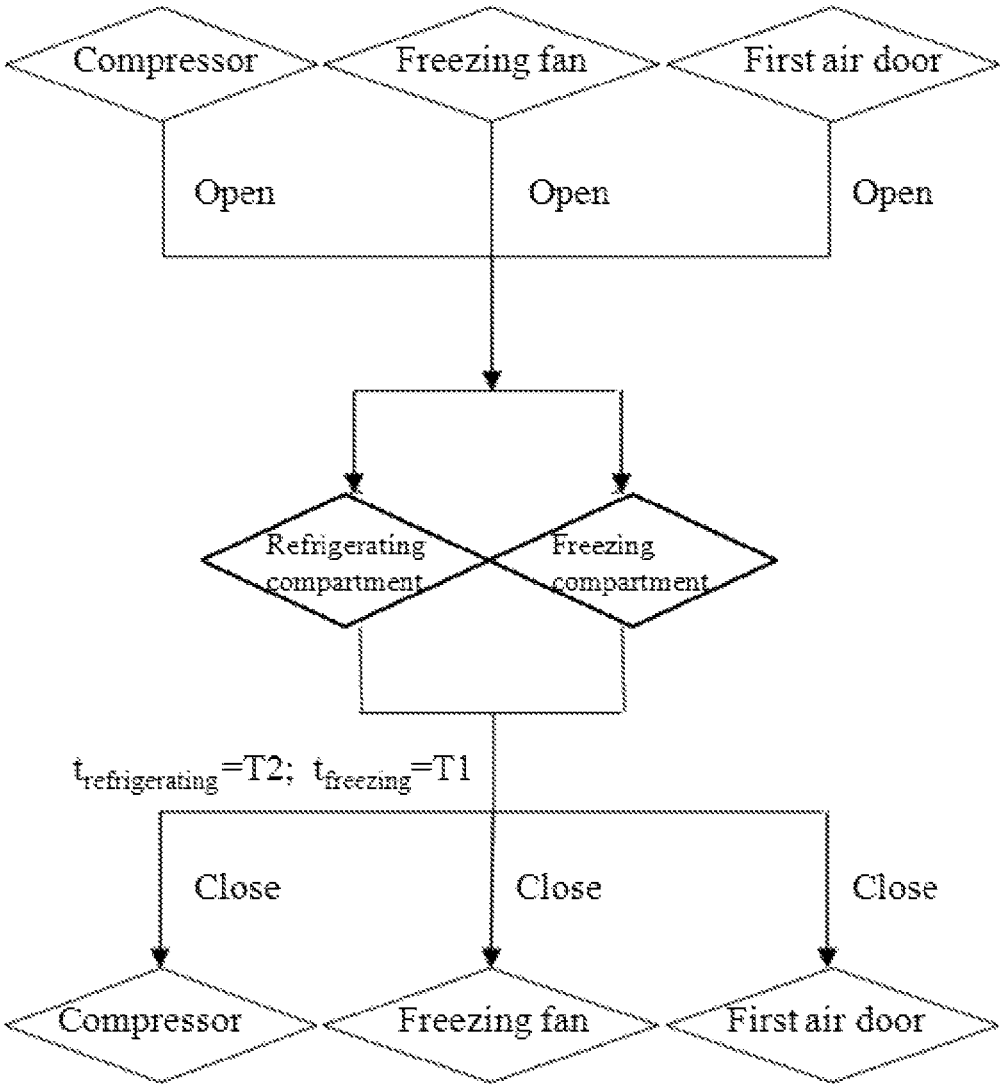
FIG. 5 is a schematic diagram of a refrigerator in a first working mode according to an embodiment of the present invention.

As shown in FIG. 5, when the refrigerator 100 is in the first working mode, the freezing compartment 20 is preset to be at a first temperature T1, the refrigerating compartment 10 is preset to be at a second temperature T2, and the control system controls the second air door 41 to be shut down. Meanwhile, the control system controls the first air door 31 to be opened to a first preset opening degree according to the first temperature T1 and the second temperature T2. The first temperature T1 is in a freezing temperature range. The second temperature T2 is in a refrigerating temperature range.

Specifically, the user sets the required first temperature T1 and second temperature T2 at a display screen, a rotary knob or the like of the control system. Or the user firstly sets the refrigerator 100 to be in the first working mode and then performs temperature setting.

Then, the control system controls the compressor 51 and the freezing fan 52 to be turned on. The control system controls the second air door 41 to be closed. The first air door 31 is opened to the specified first preset opening degree according to a user instruction. For example, when the set second temperature T2 is 10° C., the first air door 31 is opened by a half, and when the set second temperature T2 is 5° C., the first air door 31 is opened by three quarters.

When the freezing temperature sensor 21 senses that the current temperature t of the freezing compartment 20 reaches the first temperature T1 and the refrigerating temperature sensor senses that the current temperature t of the refrigerating compartment 10 reaches the second temperature T2, the control system controls the compressor 51 to stop working, and controls the freezing fan 52 to stop working after a time delay. Meanwhile, the control system controls the first air door 31 to be closed.

Here, the refrigerating temperature range is an above-zero temperature range, and the freezing temperature range is a sub-zero temperature range.

It should be noted that the sequence relationship of the above steps may be appropriately adjusted. For example, the compressor 51 and the freezing fan 52 may be started first before performing temperature setting and the like.

Figure 6:
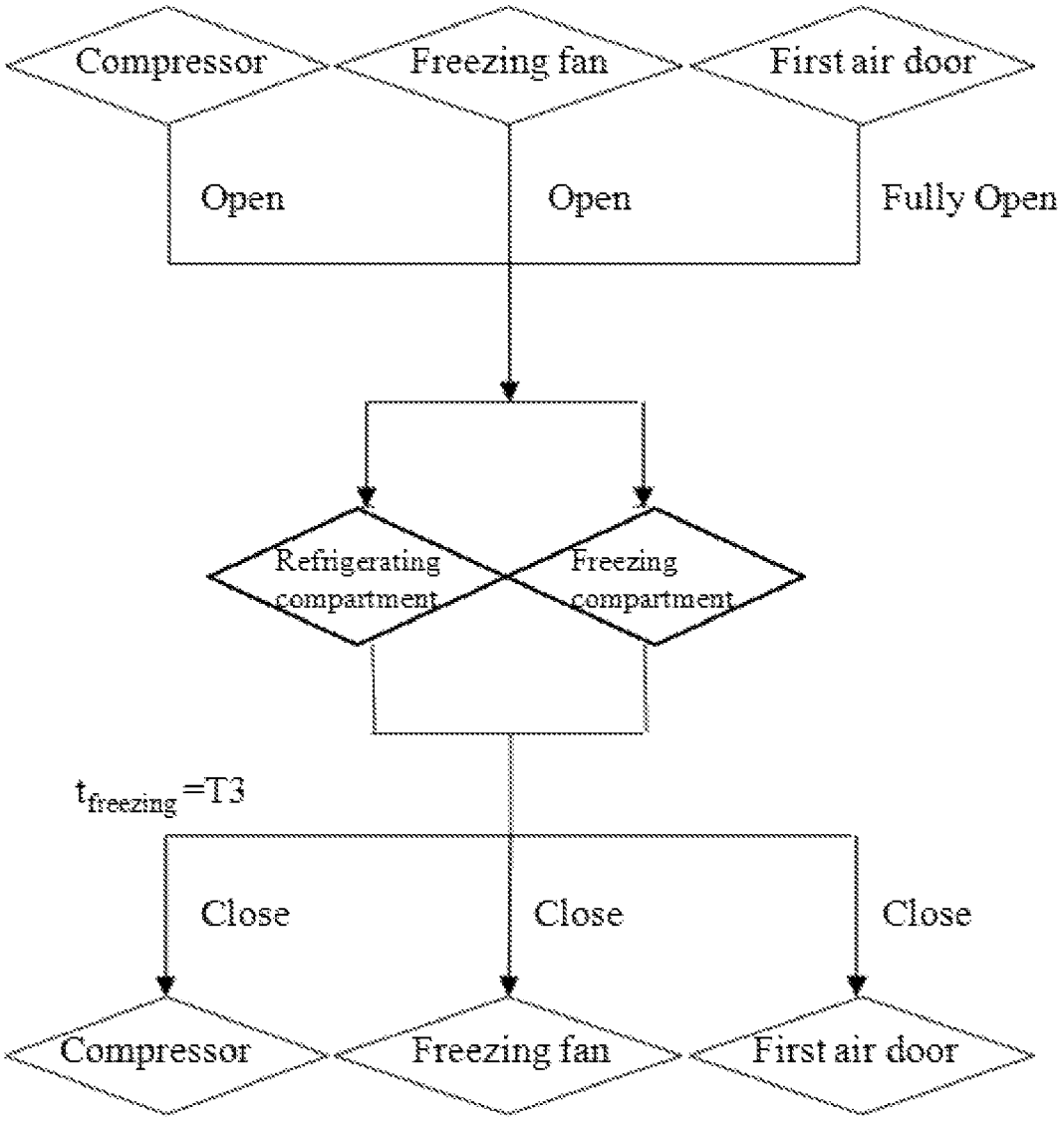
FIG. 6 is a schematic diagram of a refrigerator in a second working mode according to an embodiment of the present invention.

As shown in FIG. 6, when the refrigerator 100 is in the second working mode, the freezing compartment 20 is preset to be at a third temperature T3, the refrigerating compartment 10 is preset to be at a fourth temperature T4, the control system controls the second air door 41 to be closed, and meanwhile, the control system controls the first air door 31 to be fully opened. The third temperature T3 and the fourth temperature T4 are both in the refrigerating temperature range.

Specifically, the user firstly sets the required third temperature T3 and fourth temperature T4 at a display screen, a rotary knob or the like of the control system. Or the user firstly sets the refrigerator 100 to be in the second working mode and then performs temperature setting.

Then, the control system controls the compressor 51 and the freezing fan 52 to be started, controls the second air door 41 to be closed, and controls the first air door 31 to be fully opened; that is, the first air door 31 is in a fully open state.

When the freezing temperature sensor 21 senses that the current temperature t of the freezing compartment 20 reaches the third temperature T3, the control system controls the compressor 51 to stop working, and controls the freezing fan 52 to stop working at a time delay. Meanwhile, the control system controls the first air door 31 to be closed.

Figure 7:
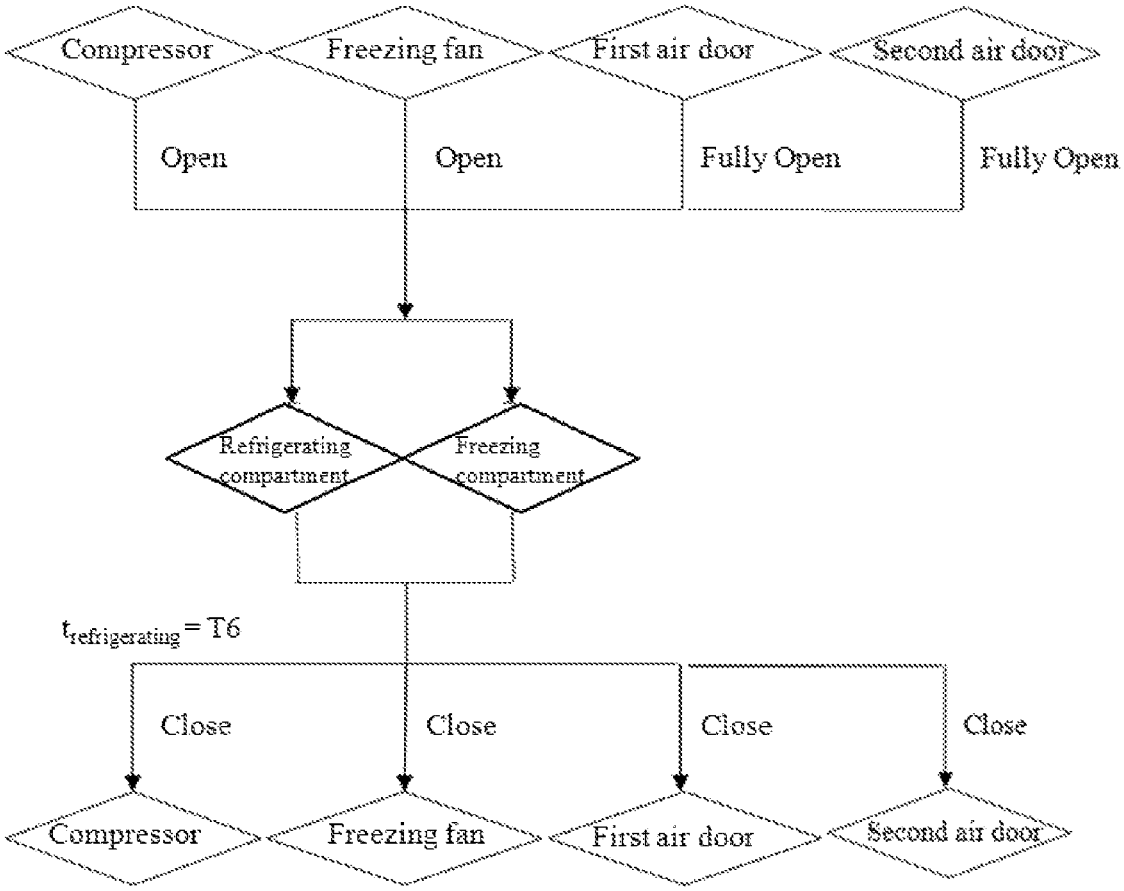
FIG. 7 is a schematic diagram of a refrigerator in a third working mode according to an embodiment of the present invention.
Figure 8:
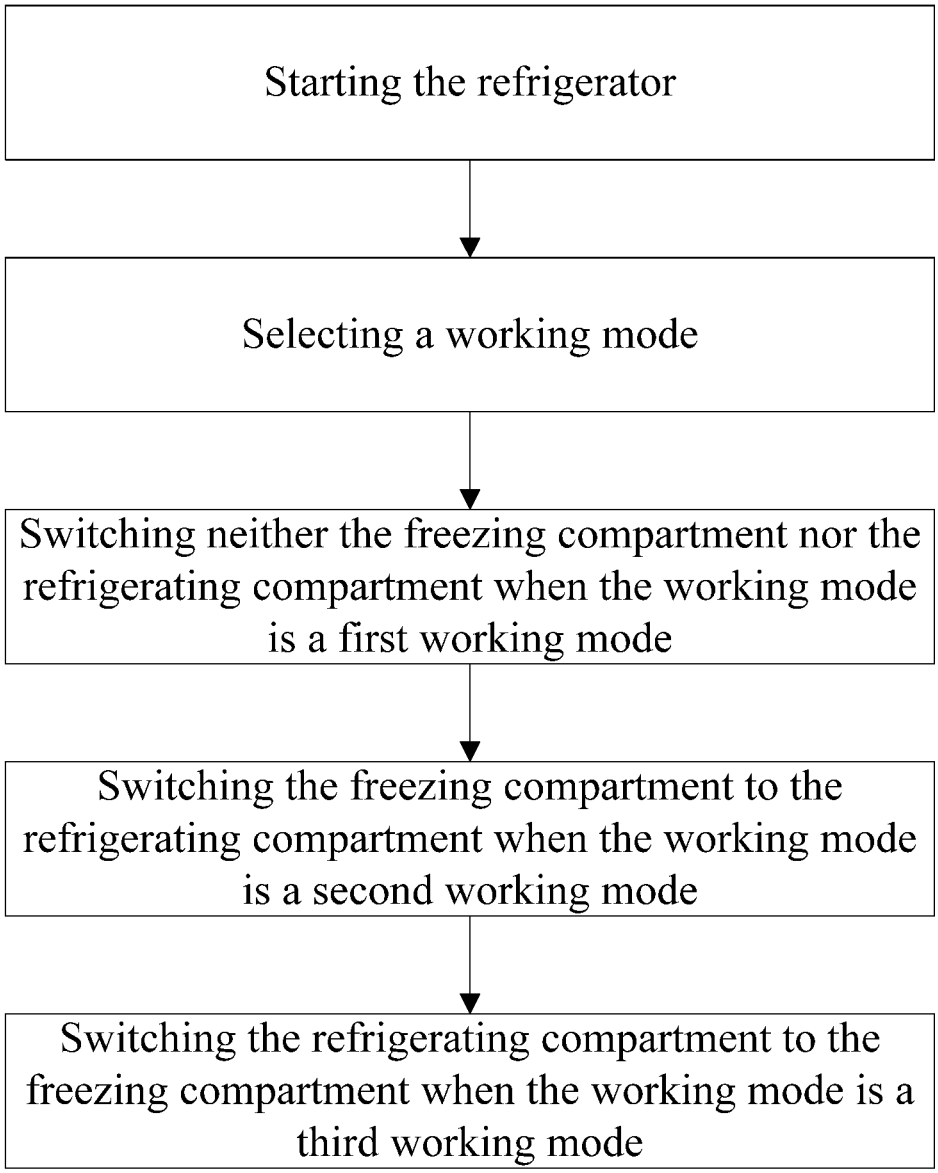
FIG. 8 is a diagram of the steps of a control method for a refrigerator according to an embodiment of the present invention.

As shown in FIG. 7, when the refrigerator 100 is in the third working mode, the freezing compartment 20 is preset to be at a fifth temperature T5, the refrigerating compartment 10 is preset to be at a sixth temperature T6, and the control system controls both the first air door 31 and the second air door 41 to be fully opened. The fifth temperature T5 and the sixth temperature T6 are both in the freezing temperature range.

Specifically, the user firstly sets the required fifth temperature T5 and sixth temperature T6 at a display screen, a rotary knob or the like of the control system. Or the user firstly sets the refrigerator 100 to be in the third working mode before performing temperature setting.

Then, the control system controls the compressor 51 and the freezing fan 52 to be started, and controls the first air door 31 and the second air door 41 to be fully opened.

When the refrigerating temperature sensor senses that the current temperature t of the refrigerating compartment 10 reaches the sixth temperature T6, the control system controls the compressor 51 to stop working, and controls the freezing fan 52 to stop working. Meanwhile, the control system controls the first air door 31 and the second air door 41 to be closed.

The invention also provides a control method for a single-system air-cooled refrigerator. In combination with the structure of the above refrigerator 100, the control method comprises the steps of: starting the refrigerator 100; selecting a working mode; switching neither a freezing compartment 20 nor a refrigerating compartment 10 when the working mode is a first working mode; switching the freezing compartment 20 to the refrigerating compartment 10 when the working mode is a second working mode; and switching the refrigerating compartment 10 to the freezing compartment 20 when the working mode is a third working mode.

Here, the user can switch the compartments (the refrigerating compartment 10 and the freezing 20 compartment) autonomously when in need. Greater convenience and flexibility are realized. The storage needs of the user for a large number of specific articles when the season changes or is at a certain time period, such as the need for storing frozen fresh food during holidays, and the need for storing large amounts of refrigerated water and fruits during the dry season in tropical areas, are met. More choices and more flexible experience are given to the user.

It should be noted that the above steps are not limited to the sequence, and may be determined according to actual conditions.

Specifically, the step "switching neither the freezing compartment 20 nor the refrigerating compartment 10 when the working mode is the first working mode" specifically comprises: presetting the freezing compartment 20 to be at a first temperature T1 and the refrigerating compartment to be at a second temperature T2 when the refrigerator 100 is in the first working mode, the first temperature T1 being in a freezing temperature range, and the second temperature T2 being in a refrigerating temperature range; and controlling the second air door 41 to be closed, and meanwhile controlling the first air door 31 to be opened to a first preset opening degree according to the first temperature T1 and the second temperature T2.

The step "switching the freezing compartment to the refrigerating compartment when the working mode is a second working mode" specifically comprises: presetting the freezing compartment 20 to be at a third temperature T3 and the refrigerating compartment to be at a fourth temperature T4 when the refrigerator 100 is in the second working mode, the third temperature T3 and the fourth temperature T4 being both in the refrigerating temperature range; and controlling the second air door 41 to be closed while controlling the first air door 31 to be fully opened.

The step "switching the refrigerating compartment to the freezing compartment when the working mode is a third working mode" specifically comprises: presetting the freezing compartment 20 to be at a fifth temperature T5 and the refrigerating compartment 10 to be at a sixth temperature T6 when the refrigerator 100 is in the third working mode, the fifth temperature T5 and the sixth temperature T6 being both in the freezing temperature range; and controlling the first air door 31 and the second air door 41 to be fully opened.

Other explanations for the control method for a refrigerator according to the present invention may refer to the above explanation for the structure of the refrigerator, and details are not repeated here again.

It should be understood that although the description is described based on the embodiments, not every embodiment includes only one independent technical solution. This statement of the description is only for clarity. Those skilled in the art should treat the description as a whole, and technical solutions in all of the embodiments may also be properly combined to form other embodiments that will be understood by those skilled in the art.

The above detailed description only aims to specifically illustrate the available embodiments of the present invention, and is not intended to limit the protection scope of the present invention. Equivalent embodiments or modifications thereof made without departing from the spirit of the present invention shall fall within the protection scope of the present invention.

What is claimed is:

1. A single-system air-cooled refrigerator, comprising a refrigerating compartment and a freezing compartment, wherein the refrigerator further comprises:

a first air duct and a second air duct, which respectfully communicate with the refrigerating compartment and the freezing compartment;

a first air door and a second air door which open and close the first air duct and the second air duct respectively;

a refrigerating system, configured to supply cold air to the freezing compartment; and a control system, configured to control opening and closing of the first air door and the second air door to implement a first working mode, a second working mode, or a third working mode of the refrigerator, wherein the first working mode is that the freezing compartment remains in a freezing condition and the refrigerating compartment remains in a refrigerating condition, the second working mode is that the freezing compartment is changed to keep a refrigerating condition, and the third working mode is that the refrigerating compartment is changed to keep a freezing condition;

wherein the refrigerating system comprises a freezing fan and a compressor, and when the refrigerator is in the first working mode or the second working mode, the control system controls the freezing fan to be shut down after controlling the compressor to be shut down for a preset delay time.

2. The single-system air-cooled refrigerator according to claim 1, wherein when the refrigerator is in the first working mode, the freezing compartment is preset to be at a first temperature, the refrigerating compartment is preset to be at a second temperature, the control system controls the second air door to be closed, meanwhile the control system controls the first air door to be opened to a first preset opening degree according to the first temperature and the second temperature, the first temperature is in a freezing temperature range and the second temperature is in a refrigerating temperature range.

3. The single-system air-cooled refrigerator according to claim 2, wherein when the refrigerator is in the second working mode, the freezing compartment is preset to be at a third temperature, the refrigerating compartment is preset to be at a fourth temperature, the control system controls the second air door to be closed, meanwhile, the control system controls the first air door to be fully opened, and the third temperature and the fourth temperature are both in the refrigerating temperature range.

4. The single-system air-cooled refrigerator according to claim 3, wherein when the refrigerator is in the third working mode, the freezing compartment is preset to be at a fifth temperature, the refrigerating compartment is preset to be at a sixth temperature, the control system controls the first air door and the second air door to be both fully opened, and the fifth temperature and the sixth temperature are both in the freezing temperature range.

5. The single-system air-cooled refrigerator according to claim 1, wherein the refrigerating system is communicated with the freezing compartment by a freezing air hole, the first air duct is communicated with the refrigerating compartment by a first refrigerating air hole, the second air duct is communicated with the refrigerating compartment by a second refrigerating air hole, and the first refrigerating air hole and the second refrigerating air hole are both larger than the freezing air hole.

* * * * *